US006466764B2

(12) United States Patent
Jacob et al.

(10) Patent No.: US 6,466,764 B2
(45) Date of Patent: Oct. 15, 2002

(54) ELECTROPHOTOGRAPHIC PRINTER EMPLOYING HEATED PRESSER ROLLERS TO PRECONDITION PRINT MEDIA

(75) Inventors: Steve A. Jacob, Boise, ID (US); Kurt R. Bengtson, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/814,296

(22) Filed: Mar. 19, 2001

(65) Prior Publication Data

US 2002/0131800 A1 Sep. 19, 2002

(51) Int. Cl.[7] ..... G03G 15/00

(52) U.S. Cl. ..... 399/390; 399/402

(58) Field of Search ..... 399/361, 381, 399/388, 390, 401, 402

(56) References Cited

U.S. PATENT DOCUMENTS 5,099,281 A * 3/1992 Bhagat ..... 399/390 X
5,412,459 A * 5/1995 Borsuk et al. ..... 399/296
6,128,465 A * 10/2000 Castelli ..... 399/381

* cited by examiner

*Primary Examiner*—William J. Royer

(57) ABSTRACT

Electrophotographic printers are provided with a roller type, sheet pretreatment device for providing successive sheets with substantially the same moisture content and, hence, substantially the same electrostatic properties.

12 Claims, 4 Drawing Sheets

ELECTROPHOTOGRAPHIC PRINTER EMPLOYING HEATED PRESSER ROLLERS TO PRECONDITION PRINT MEDIA

BACKGROUND OF THE INVENTION

1. Field of the Invention

The present invention generally relates to electrophotographic printers. More particularly, it relates to apparatus and techniques for improving the print quality of such printers by preconditioning the print media with heat and/or pressure.

2. Prior Art

Electrophotographic printing processes generally comprise the steps of using a laser beam to form an electrical latent image on a charged photoconductor drum, developing that latent image with a toner, transferring the resultant toner image onto a transfer substrate such as a sheet of paper and then fusing the toner image to the transfer substrate by means of heat, pressure and the like. Those skilled in this art will appreciate that the toner can be particulate or liquid in nature. In either case the toner fusing operation becomes especially involved in the case of electrophotographic color printing processes wherein images employing various colors, e.g., cyan, yellow, magenta and black (C, Y, M, K) toner particles are successively printed on a photoconductive drum and then transferred from the drum to a print media. In such processes, each successive color image printed on the sheet of print media (e.g., paper) is usually individually fused thereon.

It is well known that the quality of electrophotographic printing processes can vary with changes in ambient temperature and relative humidity. Print quality also can vary as the electrophotographic printer itself heats up during periods of extended use. These variations are generally related to the moisture content of the individual sheets of print media undergoing electrophotographic printing. For example, it is well known that the physical size of a sheet of paper (and especially bond paper) can vary with the paper's moisture content. A standard sheet of 8½×11 inch bond paper, for example, can shrink as much as a quarter of an inch in either dimension as it goes through an electrophotographic printer's pressure/fuser assembly. Such changes in paper size are sometimes annoying to a reader. They can be especially annoying in duplex printing situations where a sheet of paper receives printed information on a first side and then undergoes a heating and pressing operation that fuses the toner to the paper. This heating and pressing operation shrinks the paper. The sheet of paper then undergoes a duplex printing operation wherein the second side of the sheet receives printed information. In this circumstance the printed information on the second side of some kinds of paper will tend to "show through" the paper at the borders of the first side. This condition can create visual effects that vary from reader annoyance, to unprofessional appearance, to commercial unacceptability.

Those skilled in this art also will appreciate that, in order to carry out a toner transfer, the print media passes between a toner transfer roller and the photoconductor drum. During the toner transfer, the transfer roller electrostatically attracts toner away from the surface of the photoconductor drum and onto the surface of the print media (e.g., a sheet of paper). The electrical resistivity of the print media is one of the many factors involved in this electrostatic transfer of the toner from the drum to the media. The sheet's electrical resistivity is, in turn, especially effected by the moisture content of the media. Therefore, one of the primary objects of this invention is to precondition each sheet of print media (e.g., each sheet of paper) in a substantially uniform manner so that successive sheets of that print media will have virtually the same moisture content (and hence virtually the same electrical resistivity and hence the same electrostatic properties) as they pass between the transfer roller and the photoconductor drum. This uniformity of electrostatic properties of each successive sheet of print media helps to provide more uniform and, hence better, electrophotographic printing results.

SUMMARY OF THE INVENTION

This invention is particularly concerned with the use of pressure/heater devices to pretreat successive sheets of media (e.g., successive sheets of paper) that undergo electrophotographic printing processes. This pressure/heat pretreatment can be introduced into an otherwise conventional electrophotographic printing process. It takes place prior to the point in such a process where the toner image is transferred to the paper. The herein described pretreatment process serves two purposes. It preshrinks successive sheets of print media (e.g., paper) to a uniform size. Thus, it serves to minimize subsequent sheet shrinkage after the toner has been applied to one side of the paper and then duplexed. Applicant's pressure/heat pretreatment also serves to provide successive sheets passing through an electrophotographic printing apparatus with substantially the same moisture content—and hence substantially the same electrostatic properties. This is especially useful in uniformly transferring successive toner images from the photoconductor drum to successive sheets of paper as said sheets of paper pass between the photoconductor drum and the transfer roller.

The electrophotographic printing apparatus of this patent disclosure is especially characterized by the fact that it is provided with a pressure/heater device that is preferably comprised of two opposing rollers that roll over each other in pressured, rolling contact. In some of the preferred embodiments of this invention, at least one of the two opposing rollers will contain a heating device such as an inductive heater element or a halogen tube. Use of two opposing rollers wherein each of the two opposing rollers contains a heating device is also contemplated in the practice of this invention. Use of a powered heater roller also is contemplated. Use of two separately powered rollers is also possible, but not preferred.

The temperature and pressure conditions existing in the pressure/heater devices of this patent disclosure (e.g., pressure heater device 54/56 of FIG. 2 and/or pressure heater device 46/48 of FIG. 3) can vary considerably. They can vary with respect to each other and they can vary with respect to the residence time of a sheet of print media (e.g., a sheet of 8½×11 inch paper) in said pressure/heater devices. Generally speaking, the temperature of the roller surface of the heater roller should serve to soften (but not melt) a toner material. Generally speaking, such temperatures may vary between about 150 and about 350° F. Temperatures between about 250 and 350° F. are however somewhat preferred in those cases where polymer based toner particles are being employed in the inkjet printing process. The pressure conditions experienced by a sheet of media, and especially a sheet of paper, will generally range between about 232 and about 472 psi. Pressures between about 400 and about 472 psi are preferred, especially when the heater roller temperature is between about 329° F. and about 374° F.

The residence time of a sheet of media in a pressure/heater device of this patent disclosure is largely determined by the angular velocity of a powered drive roller. Typical residence times for an 8½×11 inch sheet of paper will be from about 2 to about 8 seconds. Residence times of about 3 to about 6 seconds are more preferred. These preferred residence times generally correspond to 8½×11 inch paper processing rates of about 16 to about 32 sheets per minute. Generally speaking, the shorter residence times will be used as the operating temperature is raised. For example, the lower end of the residence time range (e.g., 2–3 seconds) will generally be preferred as the temperature is raised to the upper regions of its range (e.g., 250–350° F.).

Thus, the electrophotographic printing apparatus of this patent disclosure will preferably comprise: (1) a laser printing device for creating a latent image on a photoconductor drum, (2) a sheet transport system leading to a toner transfer zone, (3) a photoconductor drum whose outside circumferential surface defines a top side of the toner transfer zone, (4) a transfer roller whose outside circumferential surface defines a bottom side of the toner transfer zone, and wherein the sheet transfer system leading to the toner transfer zone further comprises a (5) sheet pretreatment device for providing pressure and heat to successive sheets in order to provide said sheets with substantially the same moisture content and, hence, substantially the same electrostatic properties. Such an electrophotographic printing apparatus will preferably have two opposing rollers that create a nip and wherein at least one of the two opposing rollers contains a heating device such as an inductive heater element or halogen tube. In other, less preferred, embodiments of this invention, the electrophotographic printing apparatus pretreatment device may have two opposing rollers that each contain a heating device and its own means of powered rotation.

The apparatus and methods of this patent disclosure are especially well suited to electrophotographic printing processes wherein the sheet pretreatment process and the toner fixing step are carried out by the same pressure/heater (fuser) device. For example, such an electrophotographic apparatus might comprise: (1) a laser device for creating an image on a photoconductor drum, (2) a toner hopper for storing and dispensing toner particles on to the photoconductor drum, (3) a first sheet transport system that leads from a sheet dispenser tray to the pressure/heater device and then to an internal sheet collection tray (which may also help perform a duplexing function), (4) a second sheet transport system that carries a sheet from the internal sheet collection tray to the toner transfer zone, (5) a photoconductor drum whose outside surface defines a first or top end of the toner transfer zone, (6) a transfer roller whose outside surface defines a second or bottom end of the toner transfer zone, (7) a second sheet transport system that leads from the toner transfer zone to the pressure/heater (fuser) device and (8) a pressure/heater (fuser) device having a first mode of operation for providing successive sheets with substantially the same moisture content and a second mode of operation for fixing the toner to the sheet.

DETAILED DESCRIPTION OF THE INVENTION

Figure 1:
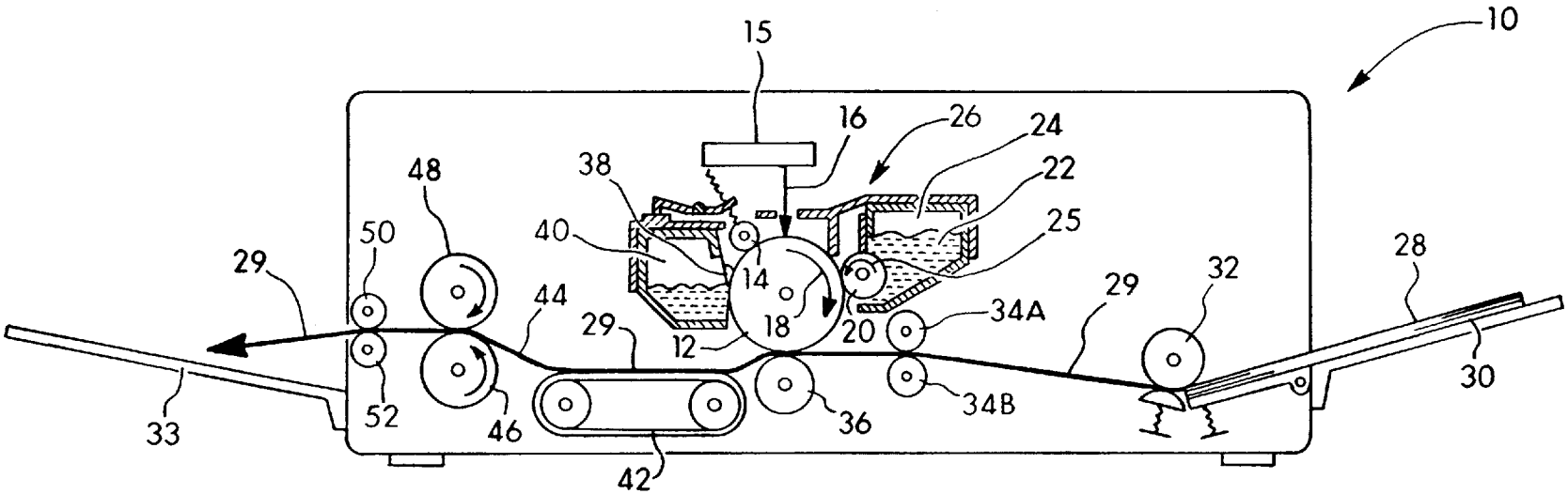
Fig. 1 (Prior Art)
FIG. 1 is a cross sectional view of a generalized, prior art electrophotographic printer.

FIG. 1 shows a cross sectional view of a highly generalized prior art electrophotographic printer 10. This prior art electrophotographic printer 10 contains a photoconductor drum 12 upon which a latent electrostatic image is placed, and thereafter removed, by methods well known to the electrophotographic printing arts. For example, a charge roller 14 can be used to charge the surface of the photoconductor drum 12 to a predetermined voltage. A laser scanner 15 emits a laser beam 16 which is pulsed on and off as it is swept across the surface of the photoconductor drum 12 and thereby discharging select portions of said surface according to a computer program. The selectively discharged portions of the surface of the drum 12 constitute a latent electrostatic image. The photoconductor drum 12 rotates (e.g., in the clockwise direction suggested by arrow 18) into contact with a developer roller 20.

The developer roller 20 is used to develop the latent electrostatic image in those places where the surface of the photoconductor drum 12 has been selectively discharged by the laser beam 16. Charged toner particles 22 having magnetic properties, stored in a toner hopper 24 of an electrophotographic print cartridge 26, are moved from within the toner hopper 24 to the developer roller 20. For example, a magnet (not shown) located within the developer roller 20 can be used to magnetically attract charged toner particles 22 to the surface of the developer roller 20. As the developer roller 20 rotates (e.g., in the counterclockwise direction 25 shown in FIG. 1), the charged toner particles 22 on the surface of the developer roller 20 are electrostatically drawn across a gap between the surface of the photoconductor drum 12 and the surface of the developer roller 20 and thereby develop the latent electrostatic image in those areas of the photoconductor drum 12 that were not discharged by the laser beam 16. This developed electrostatic image is then ready to be transferred to a print medium such as a sheet of paper.

To this end, the printer 10 is shown provided with a stack of print media such as a stack of sheets of paper. Individual sheets 28 of the print media (paper) are individually unloaded from a media holding tray 30 by a pickup roller 32. Such a sheet of paper 28 then follows a media path 29 defined within the electrophotographic printer 10 by an array of media handling and guiding devices such as rollers, belts, side plate guides and the like. Thus, a sheet of paper 28 is taken from tray 30 and made to traverse the electrophotographic printer 10 via media path 29. It is ultimately delivered to an output tray 33. Such a media path 29 may, however, vary somewhat. For example, after being introduced into the printer 10, the print media 28 may move through drive rollers 34A and 34B in a manner such that arrival of the leading edge of the print media 28 at a predetermined place below the photoconductor drum 12 is synchronized with rotation of that drum. Thus, a region on the surface of the photoconductor drum 12 carrying a latent electrostatic image can be associated with a specific region on the print media 28. As the photoconductor drum 12 continues to rotate (e.g., in a clockwise direction 18), those portions of the photoconductor drum 12 having toner particles 22 adhering to the discharged areas of the drum's surface are transferred to select regions of the print media 28.

In order to accomplish this toner transfer, the print media 28 passes over a transfer roller 36 and under the photoconductor drum 12. That is to say that the print media passes between the transfer roller 36 and the photoconductor drum 12. Thus, the vertical space between the bottom of the drum 12 and the top of the transfer roller 36 may be regarded as a vertical, toner transfer zone. In this circumstance, the transfer roller 36 electrostatically attracts toner particles 22 away from the surface of the photoconductor drum 12 and onto the top surface of the print media 28. Among the many factors involved, this toner transfer from the photoconductor drum 12 to the top of the paper 28 is effected by the electrical resistivity of the paper. This electrical resistivity is, in turn, effected by the moisture content of the paper. This electrical resistivity of the paper effects its electrostatic properties. Thus, one of the primary objects of this invention is to precondition each sheet of paper in a uniform manner so that successive sheets of paper will have the same moisture content—and hence the same electrical resistivity—and hence the same electrostatic properties—as they pass between the transfer roller 36 and the photoconductor drum 12. This uniformity of the electrostatic properties of each successive sheet of paper helps to provide more uniform, and hence better, print results. And, as previously noted, this pressure/heater pretreatment also serves to shrink each successive sheet to a size that does not vary as much as unshrunken sheets during subsequent printing and fusing operations. Again, this advantage is especially useful in electrophotographic color printing operations where a sheet of print media experiences several successive toner laydown operations that each have a tendency to shrink a sheet of paper.

Transfer of toner particles 22 from the surface of photoconductor drum 12 to the surface of the print media 28 does not, however, occur with one hundred percent efficiency. Therefore, some toner particles will remain on the surface of photoconductor drum 12. As photoconductor drum 12 continues to rotate, those untransferred toner particles that continue to adhere to the surface of the drum 12 are removed by a cleaning blade 38 and deposited in a toner waste hopper 40. Having had the untransferred toner particles wiped from its surface, the photoconductor drum 12 is again ready to be charged by charge roller 14 to complete the photoconductor drum's rotation cycle.

Meanwhile, as the print media 28 moves further along the media path 29 (i.e., past photoconductor drum 12 and transfer roller 36), a conveyer belt 42 receives and delivers the print-carrying media 28 to an inlet guide or ramp 44 that leads to a fuser roller 46 and pressure roller 48. The print media 28 passes between the fuser roller 46 and pressure roller 48 under conditions of both pressure and heat. Preferably, the pressure roller 48 provides a powered, pressured rolling interface relationship between the two rotating roller surfaces. It also provides the motive force needed to pull the print media 28 through the fuser roller 46 and pressure roller 48.

This pressure/fusing step is essential to virtually all electrophotographic printing processes. In it, the toner that was transferred, in imagewise fashion, from the photoconductor drum 12 onto the print media 28 is fixed, by a combination of heat and pressure, to form a permanent image on the print media. The heater or fuser component (fuser roller) 46 of the pressure/fuser roller system serves to soften toner particles so that the fusing of the toner to the paper can occur at relatively low pressures. As was previously noted, the temperature, pressure and residence time conditions can vary within certain ranges that can be established by those skilled in the electrophotographic printer manufacturing arts.

Again, only the most basic architecture of such a fuser device is shown in FIG. 1. For the sake of simplicity, it is depicted as being comprised of a fuser roller 46 and a pressure roller 48. Preferably, the pressure roller 48 is powered and rolls against (and thereby drives) the fuser roller 46. Regardless of which roller is serving as a powered driver roller, the image-bearing sheet of print media passes through a nip produced between the two rollers. A heat source, such as an induction heater element or a halogen lamp, is preferably mounted in a hollow shaft of such a fuser roller 46. Thus, a combination of heat from the fuser roller and pressure from the pressure roller serve to fix the toner to form a permanent image on the media 28. Thereafter, an output roller system 50/52 (comprised of a top roller 50 turning in a clockwise manner and a bottom roller 52 turning in a counterclockwise manner) nips and pulls the print media 28 further along the media path 29 and eventually helps deposit said sheet in the output tray 33. Preferably, the output tray 33 lies outside the housing of the printer 10 for easy manual access to the finished print product.

Figure 2:
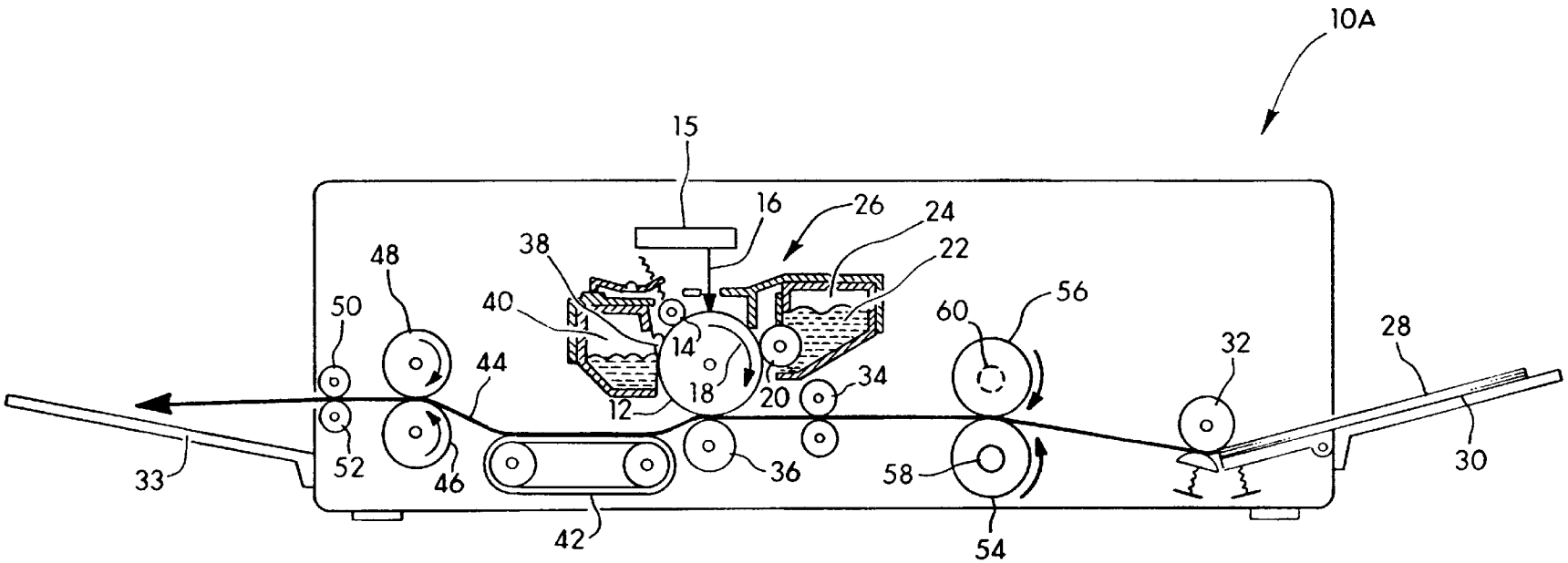
FIG. 2 is a cross sectional view of an electrophotographic printer provided with a sheet pretreatment device made and positioned in accordance with the teachings of a first embodiment of this invention.

FIG. 2 shows an electrophotographic printer 10A that is similar to the prior art electrophotographic printer 10 shown in FIG. 1. The main difference is that the printer 10A of FIG. 2 is provided with a heater/pressure roller device 54/56. For the purposes of this patent disclosure such devices also may be referred to as "roller type" pretreatment devices. They are positioned to pretreat a sheet of paper or other print media before it passes through a toner transfer zone located between the bottom outside or circumferential surface of a photoconductor drum 12 and the top or outside or circumferential surface of a transfer roller 36. The temperature, pressure and sheet residence time conditions under which this heater/pressure roller device 54/56 operates are as previously described. In any case, this heater/pressure roller device 54/56 has a heater roller 54 and a pressure roller 56. These two rollers also contact each other to create a nip into which a sheet of media, such as a sheet of paper 28, is pulled. The heater roller 54 turns in a counterclockwise direction while the pressure roller 56 turns in a clockwise direction. Thus a sheet of paper 28 is nipped and pulled through the heater roller 54, pressure roller 56 interface by the powered roller action delivered by the heater/pressure roller device 54/56. In a particularly preferred embodiment of this invention, the heater/pressure roller device 54/56 is of the same type as the prior art fuser roller 46 and pressure roller 48 device described with respect to FIG. 1. This circumstance will serve to lower the cost of applicant's printer 10A since separate and distinct heater/pressure roller devices need not be designed and constructed.

In any case, the heater roller 54 depicted in FIG. 2 is shown provided with a heat source 58 such as a halogen tube, induction heater element and the like. It also should be appreciated that either or both of the rollers 54 and 56 can have such a heater device. Thus, the pressure roller 56 is shown provided (in phantom lines) with a heater 60 as well. Similarly, either or both of the rollers 54 and 56 can supply the pressured rolling action that pulls the media sheet 28 through the roller 54, roller 56 interface. Thus, each sheet in a series of sheets taken from tray 30 will be subjected to the same heat, pressure and residence time in the heater/pressure device 54/56. Consequently, the moisture content of each successive sheet will be made more uniform relative to successive sheets taken from a stack of that media. Thereafter, an output roller system 50/52 delivers the sheet to the output tray 33.

Figure 3:
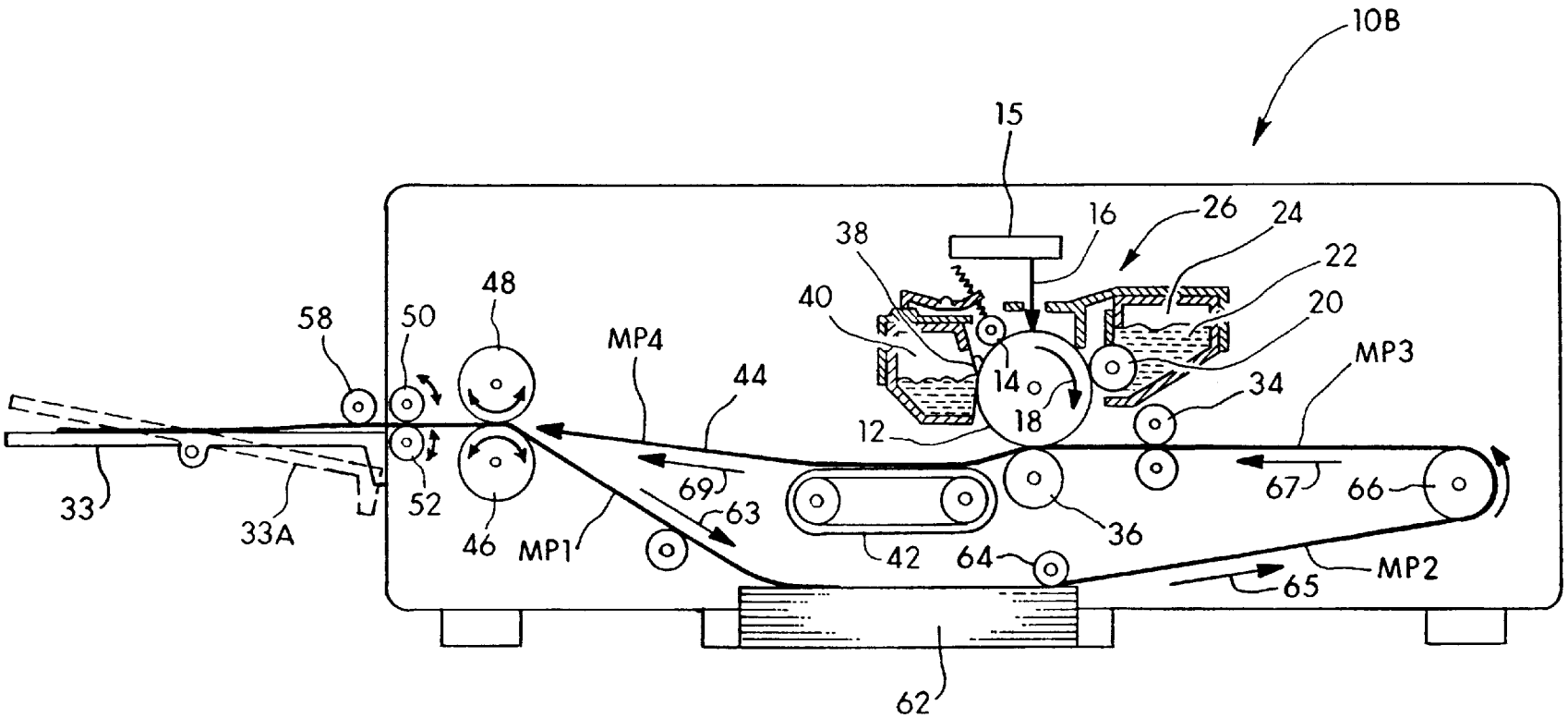
FIG. 3 is a cross sectional view of an electrophotographic printer made according to a second embodiment of this invention wherein said printer employs a prior art fuser assembly as the electrophotographic printer's sheet pretreatment device and a sheet duplexing tray.

FIG. 3 shows a preferred embodiment of this invention wherein an electrophotographic printer 10B is provided with a fuser roller 46/pressure roller 48 device (such as that shown in FIG. 1) that performs two distinct functions. First, the fuser roller 46/pressure roller 48 device is used to precondition each successive sheet of paper that is fed into the electrophotographic printer 10B. In order to feed a series of paper sheets into said printer, a tray 33 will have to be properly positioned to perform this paper feeding function. Thus, FIG. 3 shows a tray 33 that is capable of being placed in a feed mode or in a receiving mode. The feed mode is shown by drawing the tray 33 in solid lines. In this mode, the tray 33 is positioned such that a sheet of paper is picked from the top of a stack of such papers by a pick roller 58. The sheet is inserted into the printer 10B by virtue of the fact that an input/output roller system 50/52 is rotated in a manner that nips a sheet of paper and transfers it from the tray 33 and into the printer 10B.

Once inside the printer 10B, a given sheet of paper follows a media path that includes passage through the printer's fuser/pressure device 46/48. Thus each sheet is subjected to virtually the same heat and pressure conditions before any toner is placed on said sheet. These heat and pressure conditions tend to provide each successive sheet with the same moisture content—and hence the same electrostatic properties. As was previously noted, this leads to more uniform print results as a series of sheets of paper undergo electrophotographic printing. After passing through the fuser/pressure device, 46/48 the sheet is sent along a first part $MP_1$ of a media path in the direction of arrow 63 and delivered to a duplexing tray 62. After a defined series of sheets of paper have been delivered to the duplexing tray 62, the electrophotographic printer 10B is switched to its printing mode.

In this printing mode, a top sheet of paper is taken from the duplexing tray 62 (e.g., by a pick roller 64) and, in the direction generally indicated by arrow 65, delivered via a second media path part $MP_2$ to a powered roller 66 which, in turn, delivers the sheet of paper to the previously described toner transfer space between the photoconductor drum 12 and the transfer roller 36. This sheet movement takes place in the direction generally indicated by arrow 67, along a third part $MP_3$ of the media path. This third part $MP_3$ of the media path may, or may not, include the sheet's passage through guide rollers 34. In any case, because each sheet has been recently subjected to the same pressure and heat conditions in the fuser roller and pressure roller 48, each sheet arriving at the space between the transfer roller 36 and photoconductor drum 12 will have virtually the same moisture content—and hence virtually the same electrostatic properties. As was previously noted, successive sheets of paper having the same electrostatic properties will produce more uniform toner transfers between the photoconductor drum 12 and successive sheets of paper.

After receiving a toner image from the photoconductor drum 12 in the toner transfer zone, a sheet of paper is sent in the direction indicated by arrow 69 along a fourth part $MP_4$ of the media path. For example, it can be sent, via a belt 42, and a ramp 44, to the same combined action fuser roller 46 and pressure roller 48 that processed the incoming sheet. In this second or printing mode of operation, however, the rollers 46 and 48 are turning in the opposite direction that said rollers were turning when these same rollers 46 and 48 processed the incoming sheets. The general ability of this printer device 10B to change the media flow direction in this roller system is indicated by the respective two-headed arrows in fuser roller 46 and pressure roller 48. In this second mode of operation, the image on the paper is fused to said paper by the heat and pressure conditions created by the combined action of the fuser or heater roller 46 and the pressure roller 48. The pressure, heat and residence time conditions existent when the toner is being fused to the paper may be the same as, or different from, the heat, pressure and residence conditions existing in the heater/pressure device 46/48 when the paper was originally taken into the printer 10. In either case these pressure, heat and residence times will still generally fall within the ranges previously described in this patent disclosure. It might also be noted that in this second mode of operation the tray 33 can be moved to a position 33A where it can better serve as a sheet collection tray.

Figure 4:
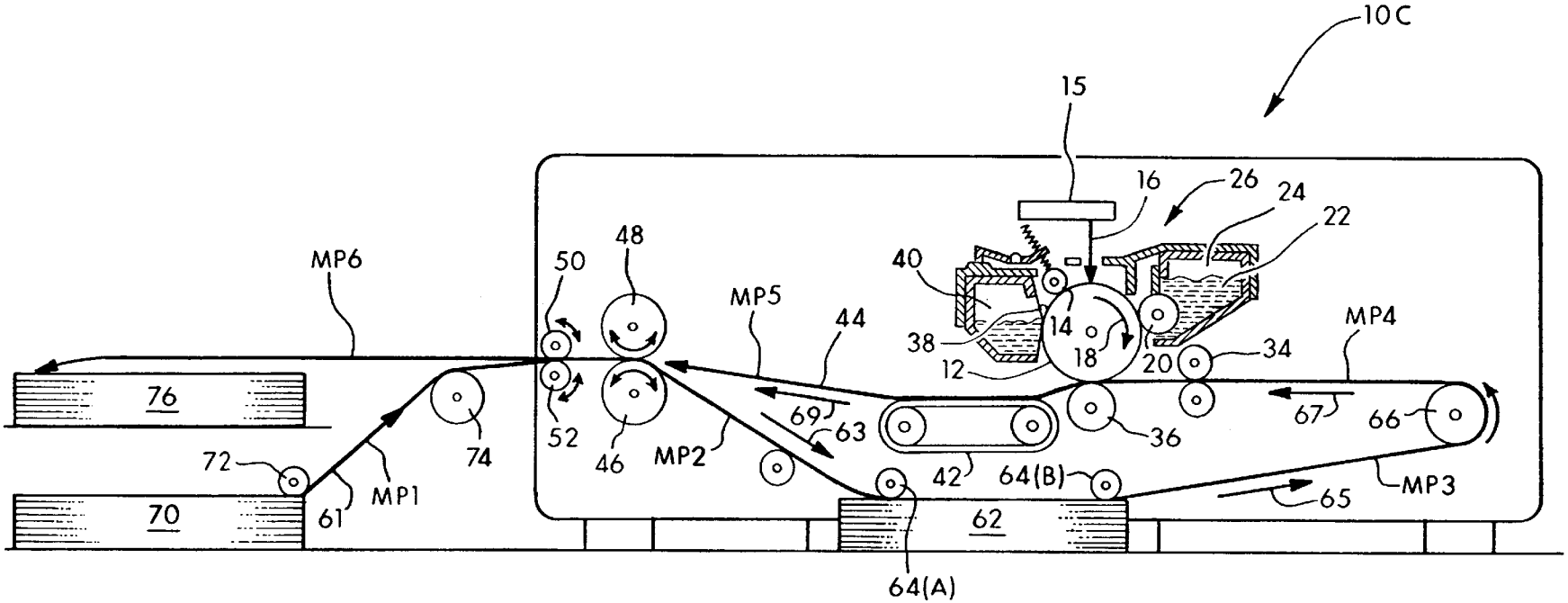
FIG. 4 is a cross sectional view of an electrophotographic printer made according to a third embodiment of this invention wherein said printer employs a prior art fuser assembly as the electrophotographic printer's sheet pretreatment device and uses a sheet dispensing tray and sheet collection tray, but does not employ a duplexing tray such as that shown in FIG. 3.

FIG. 4 is a cross sectional view of an electrophotographic printer 10C made according to another embodiment of this invention wherein said printer employs the same fuser roller/pressure roller device 46/48 as the electrophotographic printer's sheet pretreatment device and as its toner fuser. This printer 10C also uses a sheet dispensing tray 70 and a sheet collection tray 76. In this embodiment, the printer may or may not employ a duplexing tray such as that shown in FIG. 3 (as duplexing tray 62). Be that as it may, the fuser roller 46/pressure roller 48 device receives a sheet of print media from a dispensing tray 70. Such a sheet may be picked up by a pickup roller 72 and directed (in the direction suggested by arrow 61) over a first part $MP_1$ of a media path through the printer 10C by a sheet handling system that may include a roller 74. Such a sheet then passes through a first or left side nip of an input/output roller system 50/52. That is to say that said roller system 50/52 is operating in a first operating mode wherein the top roller 50 is turning in a counterclockwise direction while the bottom roller 52 is turning in a clockwise direction. Hence a first nip is formed on the left side of the roller system 50/52. Thus, a sheet traveling over media path $MP_1$ is fed into this first nip.

The sheet is then fed into the fuser roller 46/pressure roller 48 device while it too is in its first mode of operation. That is to say that the fuser roller 46 is turning clockwise while the pressure roller 48 is turning counterclockwise. The heat and pressure conditions are as previously described. After passing through this 46/48 roller device the sheet follows a media path $MP_2$, $MP_3$ and $MP_4$ (e.g., over rollers 64(A), 64(B) and 66) that leads up to the printer's toner transfer zone. This path may or may not include a duplexing tray 62. Thus each sheet is subjected to virtually the same heat and pressure conditions (by passage through the fuser roller/pressure roller device 46/48) before any toner is placed on said sheet. Here again, these uniform heat and pressure conditions tend to provide each successive sheet with the same moisture content—and hence the same electrostatic properties. As was previously noted, these uniform electrostatic properties leads to more uniform print results as a series of sheets of paper undergo electrophotographic printing.

After receiving a toner image from the photoconductor drum 12 in the toner transfer zone, a sheet of print media is sent (in the direction indicated by arrow 69) along a fifth part $MP_5$ of the media path (via belt 42, and ramp 44), to the same fuser roller 46 and pressure roller 48 device that processed the incoming sheet. In this second mode of operation, the rollers 46 and 48 are turning in the opposite direction that said rollers were turning when these same rollers 46 and 48 were pretreating the incoming sheets. The general ability of this printer device 10C to change the media flow direction is indicated by the respective two-headed arrows in fuser roller 46 and pressure roller 48.

Thus, in this second mode of operation, the image on the paper is fused to said paper by the pressure/heat conditions created by the combined action of the fuser or heater roller 46 and the pressure roller 48. Here again, the pressure, temperature and residence time conditions existent when the toner is being fused to the paper in this second mode of operation may be the same as, or different from, the heat, pressure and/or residence conditions existing in the fuser roller/pressure roller device 46/48 when the paper was originally taken into the printer 10C and preconditioned. In any case these pressure, temperature and residence times will still generally fall within the ranges previously described in this patent disclosure. Thereafter the sheet is delivered (via the $MP_6$ part of the media path) to the sheet collection tray 76 via the sheet input/output roller system 50/52 by virtue of its being in second or sheet exit mode of operation (i.e., roller 50 turning clockwise and roller 52 turning counterclockwise).

Although specific embodiments of this invention have been disclosed herein in detail, it is to be understood that this was for purposes of illustration. This patent disclosure is not to be construed as limiting the scope of the invention, since the described electrophotographic printer and printing methods may be changed in several details by those skilled in the art in order to adapt these printers to particular applications without departing from the scope of the following claims and equivalents of the claimed elements.

What is claimed is:

1. An electrophotographic printing apparatus comprising:

(1) a laser printing device for creating a latent image on a photoconductor drum whose outside surface defines a first side of a toner transfer zone;

(2) a transfer roller whose outside surface defines a second side of the toner transfer zone;

(3) a roller type heat pressure device having a first mode of operation for pretreating successive sheets and a second mode of operation for fixing toner to said sheets;

(4) a first sheet transport system that leads through the roller type heat/pressure device while it is in the first mode of operation and then to a sheet duplexing tray;

(5) a sheet duplexing tray for receiving sheets from the heat/pressure device and subsequently transferring said sheets to a second sheet transport system;

(6) the second sheet transport system leads from the sheet duplexing tray to the toner transfer zone and turns the sheet over; and (7) a third sheet transport system that leads from the toner transfer zone back through the heat/pressure device in the second mode of operation and then out of said printing apparatus.

2. The electrophotographic printing apparatus of claim 1 wherein the roller type heat/pressure device has two opposing rollers and wherein one of the two opposing rollers contains a heating device and the other is a powered roller.

3. The electrophotographic printing apparatus of claim 1 wherein the roller type heat/pressure device has two opposing rollers and wherein one of the two opposing rollers contains an inductive heater element.

4. The electrophotographic printing apparatus of claim 1 wherein the roller type heat/pressure device has two opposing rollers and wherein one of the two opposing rollers contains a halogen tube.

5. The electrophotographic printing apparatus of claim 1 wherein the roller type heat/pressure device has two opposing rollers that each contain a heating device.

6. The electrophotographic printing apparatus of claim 1 wherein the roller type heat/pressure device operates at the same temperature, pressure and sheet residence time conditions when a sheet is dispensed from the apparatus as existed when the sheet was fed into said apparatus.

7. The electrophotographic printing apparatus of claim 1 wherein the roller type heat/pressure device operates at a different condition when a sheet is dispensed from the apparatus as existed when the sheet was fed into said apparatus.

8. An electrophotographic printing apparatus comprising:

(1) a laser printing device for creating a latent image on a photoconductor drum whose outside surface defines a first side of a toner transfer zone;

(2) a transfer roller whose outside surface defines a second side of the toner transfer zone;

(3) a roller type heat/pressure device having a first mode of operation for pretreating successive sheets and a second mode of operation for fixing toner to said sheets;

(4) a first sheet transport system that leads from a sheet dispensing tray, through the roller type heat/pressure device while it is in the first mode of operation and then to the toner transfer zone; and (5) a second sheet transport system that leads from the toner transfer zone back through the heat/pressure device while it is in the second mode of operation.

9. The electrophotographic printing apparatus of claim 8 wherein the roller type heat/pressure device has two opposing rollers and wherein at least one of the two opposing rollers contains a heating device and the other is a powered roller.

10. The electrophotographic printing apparatus of claim 8 wherein the roller type heat/pressure device has two opposing rollers and wherein at least one of the two opposing rollers contains a heating device employing an inductive heater element.

11. The electrophotographic printing apparatus of claim 8 wherein the roller type heat/pressure device has two opposing rollers wherein at least one of the two opposing rollers contains a heating device employing a halogen tube.

12. The electrophotographic printing apparatus of claim 8 wherein the roller type heat/pressure device has two opposing rollers that each contain a heating device.

* * * * *